United States Patent [19]

Wemmer

[11] 4,341,350

[45] Jul. 27, 1982

[54] CHEMICAL INJECTION SYSTEM FOR HIGH PRESSURE WASHERS

[76] Inventor: Otto Wemmer, 3710 Greenbriar Dr., Columbia, S.C. 29206

[21] Appl. No.: 184,457

[22] Filed: Sep. 5, 1980

[51] Int. Cl.[3] ..... B05B 9/03

[52] U.S. Cl. ..... 239/312; 239/314; 239/419; 239/433

[58] Field of Search ..... 239/310, 312, 314, 318, 239/419, 422, 433, 575, 601

[56] References Cited

U.S. PATENT DOCUMENTS

| | | | |
|---|---|---|---|
| 811,749 | 2/1906 | Somers | 239/314 |
| 2,156,655 | 5/1939 | Morgan | 239/314 |
| 2,527,009 | 10/1950 | Heberlein | 239/422 |
| 2,753,213 | 7/1956 | Offutt | 239/314 |
| 2,919,073 | 12/1959 | Akselrad et al. | 239/310 |
| 3,128,949 | 4/1964 | Kaufman | 239/318 |
| 3,972,150 | 8/1976 | Hart | 239/314 |
| 3,997,114 | 12/1976 | Hewett | 239/318 |
| 4,193,550 | 3/1980 | Juttelstad et al. | 239/314 |
| 4,197,872 | 4/1980 | Parker | 239/318 |
| 4,238,074 | 12/1980 | Coons | 239/310 |

OTHER PUBLICATIONS

"Steam Cleaning Starts With Spartan", Spartan Manufacturing Corp., Models S-100-C, S-180-C and S-12-0-C.

*Primary Examiner*—Andres Kashnikow
*Assistant Examiner*—Michael J. Forman
*Attorney, Agent, or Firm*—Pollock, Vande Sande & Priddy

[57] ABSTRACT

The present invention relates to an improved immediate action chemical injection system for selectively adding a chemical solution to the high velocity water spray discharged by a high pressure water washer. A common supply conduit has an inlet end adaptable for engagement with a low pressure source of water and has a first outlet end attached to the inlet of the high pressure water delivery system of the washer and a second outlet end attached to a completely separate chemical injection system. The high pressure water delivery system emits a spray of highly pressurized water having a substantially fan-shaped pattern which is intersected by a spray of chemical solution emitted from the chemical injection system, with the result being a high velocity spray of water and chemical being provided for use against a work surface.

17 Claims, 4 Drawing Figures

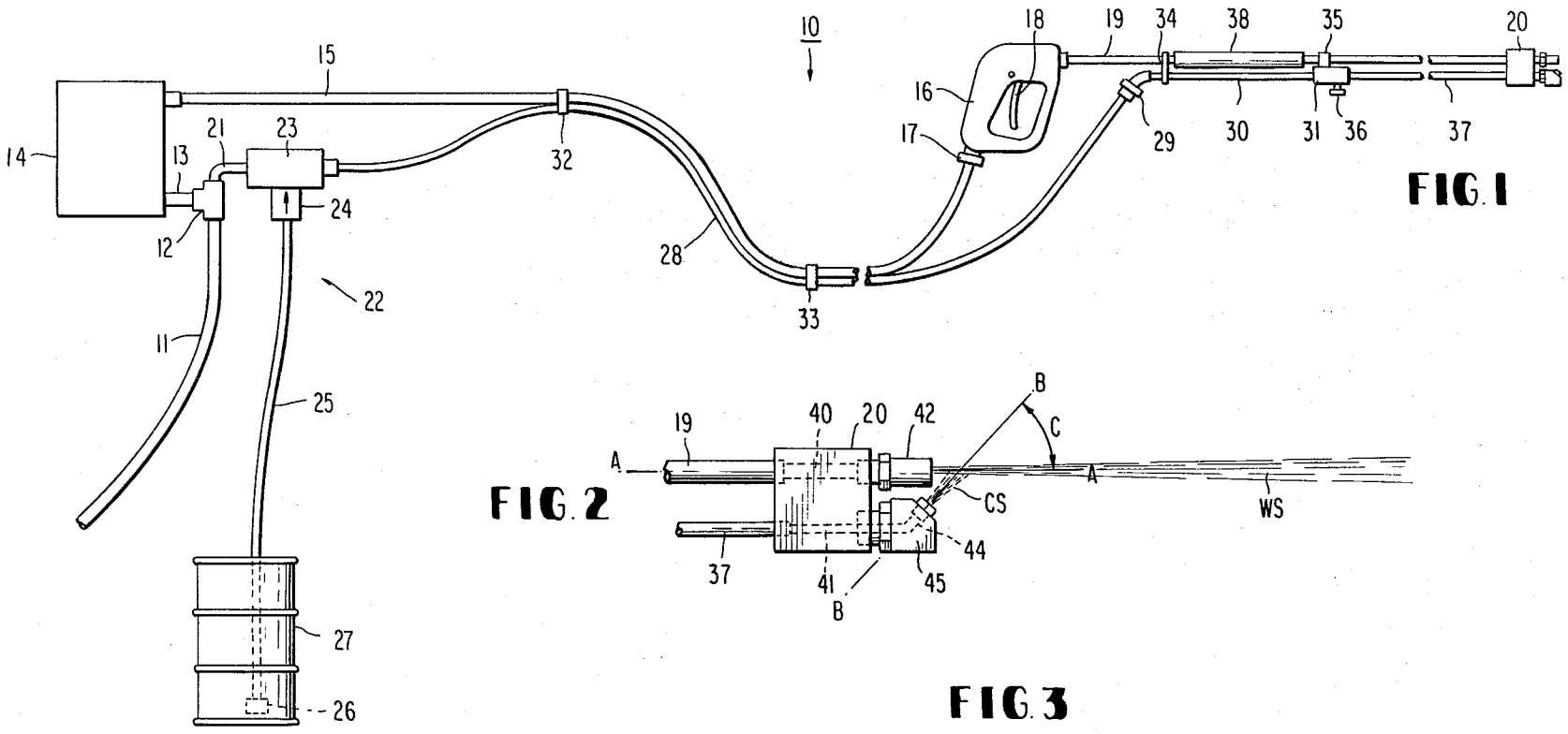
FIG. 1
FIG. 2
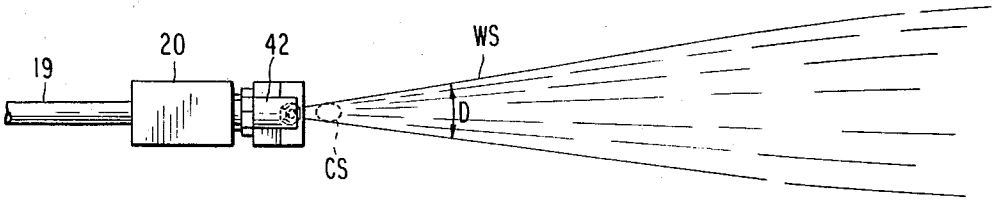
FIG. 3
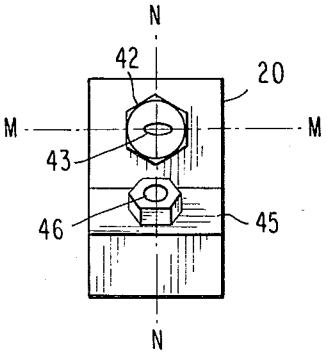
FIG. 4

CHEMICAL INJECTION SYSTEM FOR HIGH PRESSURE WASHERS

BACKGROUND OF INVENTION

The present invention relates to high pressure water washers and more particularly to a chemical injection system for selectively adding a chemical solution to the high velocity water spray discharged by the high pressure water system.

For modern pressure washer systems to be truly effective, it is necessary for such systems to be able to selectively deliver in a rapid and reliable manner a high velocity spray of water both with and without the addition of a chemical cleaning solution. However, for reasons which will become clear, many known pressure washer systems have proven less than completely satisfactory.

In one type of known pressure washer, both water and chemical are injected into the inlet of a high pressure pump assembly with the water and chemical being mixed during the pressurization process. In order to educe a flow of chemical solution into the high pressure pump inlet, it is necessary to create an inlet suction condition in the pump inlet as opposed to an inlet pressure condition. The required pump inlet suction condition might be achieved by an inlet pressure regulator or inlet float assembly. Such a system, referred to hereafter as a pump inlet injection system, also requires check valves and needle and metering valves for controlling the feed rate of water and chemical into the pump. Furthermore, the on-off and metering functions must be done at the pump rather than at the work location itself. Finally, the reaction time required to actually transport the chemical through the high pressure pump and the relatively long output hose or the like is usually at least ten seconds and can even take two minutes or more.

The elaborate and sophisticated components necessary to educe a flow of chemical solution through the high pressure pump makes for a cumbersome and complex washer system which can be exceedingly difficult to maintain and rendered inoperable by failure of one or more of the many working components forming the various valves, as well as the required pressure regulator assembly.

In an attempt to overcome the problems associated with the eductor type of pump inlet injection system, it has been suggested that the chemical solution be mixed with a body of water while in a float tank, with the mixture of water and chemical then being introduced as a single stream into the inlet of the high pressure pump. A main drawback of such a system resides in the inability to selectively control or stop the addition of chemical to the high pressure water stream of the washer system. In other words, there is no effective way to turn off the supply of chemical and provide only an impact spray of pressurized water. This inability to selectively control the flow of chemical eliminates the desirable option of a high pressure water rinse and can result in wasting excessive amounts of the chemical cleaner. In addition, because the chemical always flows through the pump assembly, water control valve and water nozzle orifice, the chemical solution can cause buildups of chemical deposits in these assemblies during regular use and flow stoppage. Where corrosive chemicals are used, this flow path may also result in corrosion and failure of these components. As a result of high maintenence costs, relatively slow response times, and relatively ineffective flow control, pressure washers wherein the chemical solution is injected into an inlet of the high pressure pump have proven less than completely satisfactory.

In a further effort to overcome the problems associated with delivering chemical solution through the water pump inlet, it has been suggested that a second, separate pump assembly be employed for pressurizing the chemical solution to a pressure sufficient to permit its injection downstream of the high pressure pump outlet. This further complicates the overall structure of the chemical injection system, making maintenance of the interrelated pump and valving assemblies time-consuming and costly.

In yet a further effort to overcome the problems associated with providing a chemical solution in the high pressure stream of water, it has been suggested that the high pressure discharge from the pump be routed through a low pressure bypass line in parallel with the usual high pressure line containing the pressure nozzle. This alternate line serves as a chemical application flow path and ends in a separate chemical application nozzle having a large orifice for providing water flow at sufficiently low pressure to permit operation of an eductor for educing chemical into the bypass line. During eductor operation, a significant fraction of the relatively constant pump output is routed through the bypass line, greatly reducing the pressure in both this line and the main line so that the chemical solution is applied to the work surface at relatively low pressure. Low pressure application of the chemical solution is then followed by a high pressure rinse using the usual high pressure flow path and nozzle. The cleaning efficiency of this system is much less than that achievable by impacting a chemical solution at the high velocity available from routing the full pump output through the high pressure water nozzle.

A further drawback of such a washer system is that a relatively large reaction time is still required to reroute the flow and reduce the pressure in the stream to a sufficiently low level so as to allow the eductor assembly to function. Furthermore, the eductor is near the pump and if the length of the line between the eductor and outlet nozzle is increased, as by adding additional hose to the washer system while in the field, the back pressure necessary to overcome the additional pressure drop often makes it impossible to reduce the pressure sufficiently so as to actuate the chemical eductor assembly. Also, any kinks in the hose, chemical deposits in the nozzle or other flow restrictions that may occur during use of the washer system can increase the back pressure to a level where it is difficult, if not impossible, to actuate the chemical eductor assembly in the bypass line.

In conjunction with the aforementioned approaches of chemical delivery systems, the use of electrically controlled solenoid valves, actuation switches at the operators handle, transformers and other electrical and electronic components sometimes appear to improve speed, economy and convenience of chemical delivery.

However, besides being unusually expensive in various degrees of sophistication, inherently such installations become inoperable after short initial operation periods. The maintenance trouble shooting on such over sophisticated systems is usually beyond the capability of ordinary maintenance personnel and these machines therefore become unusable.

As will become clear hereafter, the present invention provides an immediate action chemical addition system which overcomes the problems confronting known pressure washer assemblies as discussed hereabove, such as avoiding excessively complex mechanisms having relatively long reaction times and other drawbacks.

SUMMARY OF THE INVENTION

A principal object of the present invention is to provide an injection system capable of immediately adding or cutting off chemical additives to the high velocity water spray of a high pressure water washer.

A further object of the present invention is to provide a pressure washer with chemical injection wherein normal city water pressure is used to transport chemical additives to a chemical outlet nozzle for selective mixing with a spray of high velocity water emitted from a high pressure water nozzle.

Another object of the present invention is to provide a pressure washer with chemical injection wherein only water flows through the high pressure components.

Each of these, as well as additional objects, is achieved by the preferred embodiments of the present invention, which include a high pressure pump module having a fluid inlet in flow communication with a source of water or other liquid at a relatively low pressure. City tap water is normally supplied at pressures in the range of 15 to 100 psig and provides a satisfactory source of water for the pressure washer system of the present invention. A fluid outlet from the high pressure pump module is connected to a normally closed water control valve via high pressure conduits extending therebetween. The water control valve is part of a wand-like assembly which includes a spray head mounted at the opposite end of the wand from the water control valve and a rigid interconnecting high pressure conduit. The spray head, in turn, includes a water pressure nozzle in flow communication with the rigid high pressure conduit. In a preferred embodiment, the water nozzle includes an orifice capable of generating a substantially flat, fan-shaped spray of high velocity water in response to selective actuation of the water control valve. Upon actuation the water control valve preferably goes from a fully closed to a fully open position. It is to be understood that the water control valve can be omitted in some installations, and the pump selectively actuated to initiate or terminate high pressure water flow.

A chemical injection system is also in flow communication with a source of low pressure water, preferably the same city tap water as the high pressure pump inlet. The chemical injector includes an eductor head having a venturi passageway for transporting low pressure water while creating sufficient vacuum to draw chemical concentrate through an attached pickup line in flow communication with an appropriately positioned opening in the venturi passageway. Low pressure water flow through the eductor head assembly thus provides a stream of chemical solution at the eductor outlet. A filter or strainer assembly is preferably provided in the pickup line along with a check valve preventing back flow through the pickup line to the chemical container or reservoir.

Mounted in a chemical solution conduit extending from the outlet of the chemical eductor assembly to a separate chemical injection nozzle is a normally closed chemical control valve for selectively controlling or stopping the flow of chemical solution through the chemical conduit and nozzle. The chemical nozzle is also mounted on the spray head assembly and a portion of the chemical conduit is preferably rigid and forms part of the wand assembly. The chemical nozzle includes an orifice preferably constructed so as to provide a substantially conically shaped spray of chemical solution responsive to selective opening of the chemical control valve. The water pressure nozzle and the chemical nozzle are oriented in the spray head such that the chemical spray flowing along the longitudal axis of the chemical nozzle intersects the water spray flowing along the longitudinal axis of the pressure nozzle at about $\frac{1}{8}$ inch or less from the pressure nozzle and about 5/16 to $\frac{1}{4}$ inch from the chemical nozzle.

During operation of the preferred embodiment, a liquid stream of low-pressure, such as tap water from a city utility system, well water pump and tank system, or the like is supplied to both the inlet of the high pressure pump module and the inlet of the eductor head portion of the chemical injector. Water is pressurized in the pump to pressures in the range of 200 to 10,000 psig, preferably 500 to 3,000 psig, and is discharged as a highly pressurized stream of water flowing through high pressure conduits toward the water control valve. Upon selective opening of the normally closed high pressure water control valve, the stream of water flows through the rigid water conduit of the wand member and enters the water nozzle mounted in the spray head. The water is then ejected through the water nozzle orifice as a high velocity spray having preferably a substantially thin and flat fan-shaped configuration.

Simultaneously, tap water supplied to the chemical injection system communicates with the venturi-shaped passageway in the eductor head assembly for creating a suction force to draw chemical concentrate through the attached filter, pick-up tube and check valve. When flow is initiated, the chemical concentrate directly enters and mixes with the low pressure stream of water. A solution of water and chemical is then available in the downstream conduit containing the normally closed chemical control valve. Upon selective opening of the chemical control valve, the chemical and water solution flows from the chemical nozzle mounted on the spray head. The chemical solution is emitted as a generally conically shaped spray which intersects with the spray of pressurized water to form a single spray of high velocity water and chemical as required. If a high velocity water rinse spray is desired, only the water control valve is selectively actuated while the chemical control valve is kept in its normally closed position.

The pressure nozzle provides a relatively thin, flat diverging spray pattern having the aforementioned fan shape, the major plane of which is preferably substantially perpendicular to a plane defined by the longitudinal axes of the chemical and water nozzles. The angle of divergence of the fan spray in its major plane is approximately in the range of 10°–70°; preferably 15°–65° and most preferably about 25°.

While the chemical nozzle preferably provides a conically-shaped spray pattern, it is also considered within the scope of the present invention for the chemical nozzle to provide a flat, fan-like spray pattern similar to the spray pattern provided by the pressure nozzle. The orifice of the chemical nozzle is in a plane approximately prerpendicular to that of the fan water spray, and the chemical nozzle is positioned so that the chemical spray rapidly converges and mixes with the high velocity water spray at a mixing location exteriorly of both nozzles and the spray head but relatively close to the point at which the high pressure water exits the high pressure orifice. In the preferred embodiment, the angle of convergence "C" between the longitudinal axis A of the water orifice and the longitudinal axis B of the chemical orifice is in the range of 20° to 90°, preferably 30° to 60°, and most preferably about 45°. At the initial juncture of the two sprays, the chemical spray pattern should extend across or "cover" at least 50%, preferably 90%, of the transverse width of the fan water spray to insure adequate distribution and mixing of the chemical with the water before the fan spray reaches the work piece. As explained in the detailed description below, the chemical nozzle is positioned so that little or no chemical spray divergence is required to accomplish this coverage.

Because the only mechanically moving parts in the chemical injection system of the present invention are the chemical control and eductor check valves, this system has an exceptionally high level of reliability during normal operations over extended periods of use. Likewise, because the chemical stream does not at any time flow through the high pressure pump and associated components in the pump module or through the water control valve, pressure nozzle and related conduits, the chance of the chemical solution plugging up, corroding or otherwise adversely affecting these pressure washer components is eliminated, making the system practically maintenance free. Finally, because tap water pressure is present in the eductor and downstream conduit at all times, a stream of chemical solution immediately responsive to actuation of the chemical control valve is assured. A check valve in the pickup line between the supply of chemical concentrate at ambient pressure and the eductor prevents backflow through the pickup line when the chemical control valve is closed.

The chemical injection system of the present invention requires no significant overall reaction time for chemical addition as compared to known chemical injection systems for pressure washers. In addition, the composite chemical injector-pressure washer apparatus is relatively maintenance free, highly portable and easy to use in the field. Although designed primarily for portable pressure washer units, the invention can also be used with fixed industrial pressure washer installations. With either fixed or portable units, both the high pressure pump module and the chemical container and eductor can be located remotely, at 100 or more feet, from the washer wand used at the work location. The wand is light weight and easily held and directed by hand. The relatively flexible pressure hose and chemical tube communicating with the pump and eductor, respectively, do not adversely restrict such wand movement.

BRIEF DESCRIPTION OF DRAWINGS

The present invention can best be understood with reference to the accompanying drawings, in which:

FIG. 1 shows a side view of an improved pressure washer system made in accordance with a preferred embodiment of the present invention;

FIG. 2 shows a blowup side view of the outlet nozzle assembly employed in the pressure washer system in FIG. 1;

FIG. 3 shows a top view of the outlet nozzle assembly of FIG. 2; and

FIG. 4 shows an end view of the outlet nozzle assembly of FIG. 2.

DETAILED DESCRIPTION OF PREFERRED EMBODIMENT

Referring now to the attached drawings, an improved chemical injection washer system is shown which is capable of injecting a chemical solution into a spray of highly pressurized water utilizing low city tap water pressure or the like for transporting and injecting the chemical into highly pressurized water spray.

As shown in FIG. 1, the washer system itself is generally indicated by numeral 10. The washer system includes a water delivery assembly for supplying a spray of highly pressurized water and a further chemical injection assembly for selectively injecting a spray of chemical solution into the highly pressurized water spray before the spray strikes a work surface to be cleaned. A common supply conduit 11, which preferably takes the shape of a flexible hose, includes an end attached to a source of low pressure water such as city tap water having a pressure of between approximately 15 and 100 psi, not shown for purposes of simplicity. Supply conduit 11 includes a flow divider 12 which may take the form of a T-shaped fitting adaptable for allowing two separate outlet conduits to be attached to common supply conduit 11.

A first outlet conduit 13 extending from fitting 12 joins an inlet of a conventional high pressure pump module indicated in block diagram at 14. For purposes of simplicity, the internal drive mechanism of high pressure pump module 14 has not been shown. During operation, pump module 14 functions to raise the pressure of the tap water entering pump module 14 via conduit 13 from its original pressure of between 15–100 psi to a new pressure level of between approximately 500–2,500 psi or greater.

A high pressure hose 15 includes an end portion attached to an outlet of high pressure pump module 14 to provide a passageway for a stream of highly pressurized water leaving the pump. High pressure hose 15 includes a further end portion detachably connected to an inlet portion of a water control valve 16, via a detachable coupling assembly 17 positioned therebetween. Detachable coupling assembly 17 may include compatibly threaded sleeves mounted in confronting surfaces of hose 15 and water valve 16 to provide a threaded connection when concentrically disposed. Alternatively, coupling assembly 17 may comprise a convention key and groove coupling, a bayonet coupling or the like.

In a preferred embodiment, water control valve assembly 16 comprises a hollow, pistol grip shaped handle including a valve member, not shown, normally biased into a position blocking a flow passageway extending through the hollow handle. A trigger 18 is pivotally attached to the pistol grip housing and is connected to the valve member. Selective pivoting of trigger 18 causes trigger 18 to move the valve member against its biasing assembly to open the flow passageway through the pistol grip.

A rigid, high pressure pipe 19 includes a first end portion forming a fluid-tight connection with an outlet portion of water control valve 16, with an opposite end of rigid pipe 19 joining a spray head assembly 20 to be described in greater detail hereafter. Pipe 19 and spray head 20 function as a wand which can be selectively directed toward a work surface by movement of attached water control valve 16. A hand grip 38 surrounds a portion of pipe 19 to allow an operator to grip and steady pipe 19 when a stream of highly pressurized water flows therethrough.

Referring again to FIG. 1, it is noted that a further outlet conduit 21 also extends from flow divider 12 to an inlet of a chemical injection assembly generally indicated at 22. Chemical injection assembly 22 includes an eductor portion 23 having a flow passageway, not shown, wherein an intermediate portion of the flow passageway is restricted in size as compared to opposite end portions of the flow passageway, creating a venturi effect on liquids flowing therethrough. Positioned vertically below and attached to eductor portion 23 is an outlet portion check valve assembly 24. Check valve assembly 24 includes an inlet attached to an upper end portion of a substantially vertically extending chemical pick-up tube 25. Attached to an opposite, lower end portion of tube 25 is a filter 26. The lower end portion of tube 25 along with filter 26 is immersed in a container 27 storing a quantity of chemical concentrate, not shown.

Container 27 is vented to ambient pressure and may be of any convenient size and shape. For example, conventional 55 gallon drums of detergent or other chemical cleaning agents may be employed. Of course, the present invention is not limited to such relatively large containers. Rather, the chemical pick-up tube 25 and filter 26 may be immersed into a quantity of chemical agent contained in a metal or plastic bucket for smaller applications such as with pressure washer systems stocked by rental equipment dealers for use around the home or in other consumer applications. If container 27 constitutes a 55 gallon drum, pick-up tube 25 may preferably comprise a tubular member having a length of approximately 8 feet.

A continuous liquid passageway is formed through filter 26, pick-up tube 25 and check valve 24, with an outlet of the passageway joining the flow passageway passing through eductor portion 23 of chemical injector assembly 22. During operation, the normal flow of low pressure water through the variable size venturi-type passageway in head portion 23 acts to generate a suction force sufficient to draw chemical concentrate from container 27 through the above mentioned liquid passageway and into the flow passageway, causing the chemical to mix with the water flowing therethrough.

A chemical conduit 28, preferably comprising a flexible tube, includes an end portion forming a fluid-tight connection with an outlet of eductor 23. The chemical conduit may have a length substantially similar to the length of high pressure conduit 15, with a further end portion of chemical conduit 28 joining an inlet of a detachable coupling assembly 29. Coupling assembly 29 has an outlet which joins an end portion of a further, rigid conduit 30 which, in turn, has a further end portion joining an inlet portion of a chemical valve control assembly 31.

In a preferred embodiment of the present invention, intermediate portions of high pressure conduit 15 are clamped to intermediate portions of chemical conduit 28 via heat shrinkable fastening members 32 and 33. Members 32 and 33 may comprise a sleeve extending about adjacently disposed portions of conduits 15 and 28, with the sleeves shrinking into tight contact with the conduits when heated. Of course, it is considered within the scope of the present invention to substitute any conventional fastening assembly for the heat shrinkable fastening members 32 and 33.

A further fastening assembly 34 extends between intermediate portions of rigid conduits 19 and 30 in order to fixedly attach these conduits to one another. Fastening assembly 34 may comprise a bracket having a pair of openings of sufficient size so as to allow conduits 19 and 30 to pass therethrough. Finally, chemical control valve 31 may be suspended from conduit 19 via a clamp 35 attached to valve 31 and extending about pipe 19.

Like water control valve 16, chemical control valve 31 includes a valve member normally biased to a position blocking the flow of fluid through chemical control valve 31. The valve and biasing assembly has not been shown for purposes of simplicity. Chemical control valve 31 also contains an actuator, which preferably takes the form of a push button 36 which is directly connected to the valve member. Upon selective depression of push button 36, the valve member is moved against its biasing assembly, thus opening a flow passageway through chemical valve 31. When the pressure is removed from push button 36, the biasing assembly returns the valve member to its original position, thereby cutting off the flow of liquid through the valve assembly.

A further chemical conduit 37 joins an outlet of chemical valve control assembly 31 with a further inlet formed in spray head 20.

Turning to FIGS. 2–4, spray head 20 will now be discussed in detail. In a preferred embodiment, spray head 20 is molded of a metal or plastic material and includes a pair of liquid passageways 40 and 41 each extending substantially parallel to one another throughout spray head 20. Passageway 40 has a cross-sectional configuration greater than a cross-sectional configuration of passageway 41. In addition, passageway 40 and passageway 41 are substantially in the same plane as the pistol grip of water control valve 16, with an inlet of passageway 40 being attached to high pressure water conduit 19.

A high pressure water nozzle assembly 42 is releasably connected to spray head 20, with an inlet portion of high pressure nozzle 42 engaging an outlet portion of passageway 40. High pressure nozzle 42 has a longitudinal axis A—A which substantially coincides with the longitudinal axis of passageway 40. As best shown in FIG. 4, high pressure nozzle 42 further includes an orifice 43 which is preferably of elliptical cross-sectional configuration. The major axis M—M of the substantially elliptically-shaped orifice 43 forms a substantially perpendicular angle with a vertical plane N—N formed between high pressure nozzle 43 and a further chemical nozzle 45 also releasably connected to spray head 20. Because of the elliptical shape of orifice 43, high pressure water flowing through orifice 43 will be emitted as a thin, flat water spray having a fan-shaped pattern. Furthermore, because of the orientation of elliptical orifice 43, the water emitted therefrom will initially form a spray in a horizontal plane forming an extension of major axis M—M.

Turning again to FIG. 2, it is noted that flow passageway 41 includes an outlet portion 44 which is angled toward the longitudinal axis A—A. In particular, the outlet portion 44 may form an angle of substantially 45° with the remaining portion of flow passageway 41. As shown in FIG. 2, an inlet portion of flow passageway 41 is connected to chemical conduit 37, with outlet portion 44 passing through a chemical nozzle 45 threaded in the outlet of passage 41.

Chemical nozzle 45 has a generally annular orifice 46 which is best shown in FIG. 4. Furthermore, chemical nozzle 45 has a longitudinal axis B—B which substantially coincides with the longitudinal axis of outlet portion 44 of flow passageway 41. Because chemical nozzle 45 forms an angle of substantially 45° with the remaining portion of passageway 41, which extends parallel to passageway 40 and nozzle 42, the direction of liquid spray emitted from chemical nozzle 45 will differ from the direction of liquid spray emitted from high pressure nozzle 42. In particular, spray emitted from nozzle 45 will converge toward and actually intersect spray emitted from nozzle 42. The angle C of convergence between the two sprays is equal to the angle formed between longitudinal axes A—A and B—B which is substantially 45° in the preferred embodiment.

During operation of the pump assembly, low pressure tap water flows through attached conduits 11 and 13 and enters pump module 14. Pump module 14 is normally designed to deliver a constant flow rate which will dictate the specific size of the high pressure orifice 43 to be employed. For example, if the pump module 14 output volume is 3.0 gpm, a pressure nozzle with a #8 orifice will produce a line pressure of 600 psi. The pressure rating of this pump should be at least 600 psi or greater. If the pump output volume is 4 gpm, a pressure nozzle with a #8 orifice will produce a line pressure of 1,000 psi. In this case the pressure rating of the pump should be at least 1,000 psi or greater.

As the highly pressurized water is emitted through high pressure orifice 43, it forms water spray WS which begins to diverge in a substantially horizontal plane forming an extension of the axis M—M. As best shown in FIG. 3, the angle of divergence "D" is determined by measuring the angle from one side of the diverging water spray to the opposite side in its major plane defined by axis M—M. The orifice 43 of the high pressure nozzle is carefully selected to provide the desired angle "D" of fan spray divergence, with wider angles of convergence giving more spray coverage but at reduced impact pressure. The operable range for the angle of divergence D is between about 10° and 70°, with the coverage and cleaning characteristics of angles in the range of 15° to 65° being preferred. In a most preferred embodiment, the pressure nozzle 42 will have an orifice 43 capable of generating generally a fan pattern of water having an angle of divergence D of about 25°. The fan spray maintains its divergence angle fairly closely until about 1½ to 2 feet from the pressure nozzle, at which point the divergence tends to decrease as illustrated in FIG. 3.

As stated hereabove, for purposes of simplicity in design as well as overall cost savings, a standard round orifice 46 is preferred for use in the chemical spray nozzle 45. The round orifice 46 provides a generally conically shaped spray pattern C-S which usually diverges at angles in the range of 5° to 10°. If a wider chemical spray pattern C-S is desired for better distribution of the chemical solution, the chemical nozzle may also have an orifice similar in shape to the orifice 43 and capable of delivering a fan pattern of spray similar in shape to the high pressure nozzle.

During operation, a stream of low pressure tap water or the like flows through attached conduits 11 and 21 and then passes through chemical injector 22. Because of the venturi effect generated during passage through head portion 23 of injector 22, a stream of chemical concentrate is sucked into the low pressure water stream. Upon selective actuation of chemical control valve assembly 31 from its normally closed position to an alternative, open position, the stream of the low pressure water and chemical is allowed to enter and flow through control valve 31 and then travel toward spray head 20. As the stream of water and chemical flows through nozzle 45, it is emitted as the conically-shaped spray discussed hereabove. Because the longitudinal axis B—B of the chemical nozzle 45 intersects the longitudinal axis A—A of the high pressure nozzle, the chemical spray C-S intersects the water spray W-S emitted from nozzle 42.

To ensure that the chemical spray C-S initially intersects with at least 50% and preferably 90% of the transverse width of the fan water spray W-S, the two sprays preferably should intersect as close as practicable to the orifice 43 of the high pressure nozzle 42. In the preferred embodiment, this line of intersection is less than ⅛" to 3/16" from the exterior surface of the high pressure nozzle surrounding orifice 43. At this location, the fan pattern is still quite narrow and can be adequately covered by the intersecting chemical spray, even where the latter has a more gradually diverging cone pattern. To provide a greater axial length for chemical spray divergence before intersection between the two sprays occurs, the chemical orifice 46 is spaced farther away from the line of intersection than is the orifice 43, with the chemical orifice 46 being spaced between 5/16" and ½" from the line of intersection in the preferred embodiment.

The spacing of both orifices 43 and 46 from the line of intersection is also a function of the angle of convergence C defined hereabove. While in the preferred embodiment the angle of convergence C between longitudinal axis A—A and B—B is substantially 45°, the angle of convergence may vary between 90° and 20° and is preferably within the range between 60° and 30°. As the angle of convergence drops below 30°, the distribution of chemical into the high pressure water spray W-S may be inadequate to provide effective cleaning. Likewise, when the angle of convergence C rises above 60° the chemical spray C-S impact on the water spray W-S may adversely affect the momentum of the water spray.

The size of the chemical orifice 46 may also be varied, depending on the flow rate of chemical agent actually desired. When tap water is employed as the low pressure source for transporting the chemical to chemical nozzle 45, a flow rate of about ½ gpm may be obtained through the eductor portion of the chemical injector 22, requiring a chemical orifice 46 having a size of about 3/16" in order to delivery approximately 4 ounces of chemical per gallon of water in the final impact stream generated by a pressure nozzle 42 having an orifice 43 with a 3.0 gpm flow rating. The total volume of the water and chemical is equal to the volume of the water pressure nozzle 42 and the chemical nozzle 45. For example, if the water pressure nozzle has a 3.0 gpm rating and the chemical nozzle a 0.5 gpm rating, the total volume would be $3.0+0.5=3.5$ gpm. Larger or smaller chemical orifices 46 will provide greater or lesser chemical concentrations, respectively, assuming there are no other limiting conditions in the injector system design. For example, concentrations as low as 1.0 ounces chemical agent per gallon of total water may provide satisfactory cleaning, depending on the particular chemical agent employed. A ½ gpm injector flow and a 1/16" chemical orifice will provide a concentration of approximately 1.0 ounces of chemical per gallon of impact water.

The chemical injection system employed in the present invention is completely independent of the high pressure water supply system. This allows the chemical supply system to be used in cooperation with existing high pressure water washer systems provided that a spray head using nozzles arranged according to the present invention is employed for emitting both the high pressure water and chemical solution. Furthermore, while the chemical injection system is preferably powered by ordinary low pressure tap water, the present invention is equally adapable for being powered by water supplied by a low pressure pump from a portable container or the like, or from a well water system.

The present invention is not to be limited to the embodiments described hereabove, but is only to be limited by the scope of the claims following hereafter.

I claim:

1. An improved chemical injection system for injecting a chemical solution into a high velocity spray of liquid provided by a pressure washer having pressurized liquid delivery means for highly pressurizing a liquid supplied to said pressurized liquid delivery means from a source of relatively low pressure liquid and a high pressure nozzle for forming said high velocity spray by discharging said highly pressurized liquid to ambient pressure, said chemical injection system comprising:

chemical nozzle means for emitting said chemical solution as a chemical spray intersecting said high velocity spray along a line of intersection extending across at least about 50% of the transverse width of said high velocity spray;

a spray head assembly for mounting said chemical nozzle means in spaced relation to said high pressure nozzle so that said high velocity spray does not impinge upon said chemical nozzle means;

chemical conduit means for providing a liquid flow path between said chemical nozzle means and said source of relatively low pressure liquid;

an eductor means in said chemical conduit means for drawing a chemical agent into said flow path and mixing said chemical agent with said low pressure liquid to form said chemical solution, said eductor means including suction means for drawing said chemical agent into said flow path from a reservoir containing a body of said chemical agent at ambient pressure in response to flow of said low pressure liquid through said chemical conduit means; and, chemical control valve means positioned in said chemical conduit means between said eductor means and said chemical nozzle means, said chemical control valve means being selectively actuable for allowing said low pressure liquid to flow through said chemical conduit means so as to draw said chemical agent into said flow path and emit said chemical solution from said chemical nozzle means as said chemical spray.

2. An improved washer system according to claim 1, wherein said chemical injection system comprises a chemical conduit assembly extending from said injection means inlet to said chemical nozzle means, with an intermediate portion of said chemical conduit having a reduced diameter as compared to the remaining diameter of said conduit assembly.

3. An improved washer system according to claim 2 wherein said chemical injection system further comprises a chemical pick-up tube means having a vertically upper end extending from an opening in said conduit assembly adjacent said intermediate portion and having a vertically lower end immersed in a container of chemical concentrate, whereby a low pressure stream of water flowing through said intermediate portion of reduced diameter draws chemical concentrate through said pick-up tube means and into said low pressure stream.

4. An improved washer system according to claim 2, wherein said chemical injection system further comprises normally closed chemical control valve means positioned in said conduit assembly between said intermediate portion and said chemical nozzle means, said normally closed control valve means being selectively actuable for opening a flow passageway between said chemical injection means inlet and said chemical nozzle means for delivering a supply of chemical solution to said chemical nozzle means.

5. An improved chemical injection system according to claim 1 in which said chemical nozzle means includes a relatively low pressure chemical nozzle, said high pressure nozzle having a longitudinal axis extending outwardly from said spray head assembly and said chemical nozzle having a longitudinal axis extending outwardly from said spray head assembly such that the longitudinal axis of the chemical nozzle substantially intersects the longitudinal axis of the high pressure nozzle at a distance sufficiently close to the high pressure nozzle such that a spray of chemical solution emitted from the chemical nozzle along its longitudinal axis initially intersects at least about 50% of the transverse width of a spray of high velocity liquid emitted from said high pressure nozzle along its longitudinal axis.

6. An improved chemical injection system according to claim 5, wherein said high pressure nozzle includes an orifice having a substantially elongated cross-sectional configuration.

7. An improved chemical injection system according to claim 6, wherein said high pressure orifice has a substantially elliptically shaped orifice arranged within said high pressure nozzle which emits a thin spray of substantially fan-shaped configuration along the longitudinal axis of said high pressure nozzle in a plane forming an extension of a major axis of said elongated orifice.

8. An improved chemical injection system according to claim 6, wherein an angle of divergence is defined between opposite sides of the spray of high velocity water, said angle of divergence coming within a range of between 10° and 70°, respectively.

9. An improved chemical injection system according to claim 8, wherein said angle of divergence has a value of substantially 25°.

10. An improved chemical injection system according to claim 5, wherein said chemical nozzle includes an orifice having a substantially annular cross-sectional configuration.

11. An improved chemical injection system according to claim 10, wherein said substantially annularly shaped orifice arranged within said chemical nozzle forms a spray of substantially conical configuration encircling the longitudinal axis of said chemical nozzle.

12. An improved chemical injection system according to claim 5, wherein said high pressure nozzle is substantially vertically aligned with said chemical nozzle when said spray head assembly is in an upright position.

13. An improved chemical injection system according to claim 12, wherein said high pressure nozzle is positioned substantially in the same plane as chemical nozzle.

14. An improved chemical injection system according to claim 5, wherein an angle of convergence is defined by an angle formed between the longitudinal axis of said high pressure nozzle and the intersecting longitudinal axis of said chemical nozzle, with the angle of convergence having a value in the range between 20° and 90°, respectively.

15. An improved chemical injection system according to claim 14, wherein the intersecting longitudinal axes define an angle of convergence of substantially 45°.

16. An improved chemical injection system according to claim 5, wherein the spray of chemical solution emitted from the chemical nozzle intersects between 50% and 90% of the spray of high velocity water emitted from said high pressure nozzle.

17. An improved chemical injection system according to claim 5, wherein a line of intersection of said spray of chemical solution and said spray of high pressure water is spaced from the high pressure nozzle a distance less than 3/16 inch.

* * * * *